US005147508A

United States Patent [19]

Sweet

[11] Patent Number: 5,147,508

[45] Date of Patent: Sep. 15, 1992

[54] SUCTION BOX COVERS FOR CLEANING PAPERMAKING MACHINE FELTS

[75] Inventor: Douglas F. Sweet, Birmingham, Ala.

[73] Assignee: The Nash Engineering Company, Norwalk, Conn.

[21] Appl. No.: 775,004

[22] Filed: Oct. 11, 1991

[51] Int. Cl.[5] ..... D21F 1/32; D21F 1/52

[52] U.S. Cl. ..... 162/279; 162/374

[58] Field of Search ..... 162/352, 374, 279

[56] References Cited

U.S. PATENT DOCUMENTS

| | | | |
|---|---|---|---|
| 920,100 | 4/1909 | Whisner . | |
| 1,236,359 | 8/1917 | Reynolds . | |
| 1,468,057 | 9/1923 | Walker . | |
| 2,010,150 | 8/1935 | Hemphill . | |
| 2,042,198 | 5/1936 | Swauger . | |
| 2,142,711 | 1/1939 | Birch . | |
| 2,543,870 | 3/1951 | Robbins . | |
| 2,717,540 | 9/1955 | Planer . | |
| 3,218,228 | 11/1965 | Wagenknecht | 162/274 |
| 3,250,671 | 5/1966 | Walker | 162/352 |
| 3,323,981 | 6/1967 | Heys | 162/352 |
| 3,323,982 | 6/1967 | Hill | 162/352 |
| 3,420,736 | 1/1969 | Kwashiewski et al. | 162/374 |
| 3,425,901 | 2/1969 | Koffskey, Jr. | 162/352 |
| 3,438,854 | 4/1969 | Means | 162/303 |
| 3,477,907 | 11/1969 | Ely | 162/358 |
| 3,870,597 | 3/1975 | Getman et al. | 162/352 |
| 4,319,957 | 3/1982 | Bartelmuss | 162/352 |
| 4,420,370 | 12/1983 | Saad | 162/374 |
| 4,447,296 | 5/1984 | Cruse | 162/352 |
| 4,474,644 | 10/1984 | Poulsen | 162/199 |
| 4,734,164 | 3/1988 | Irwin et al. | 162/352 |
| 4,790,909 | 12/1988 | Harwood | 162/352 |
| 5,061,347 | 10/1991 | Bubik et al. | 162/352 |

FOREIGN PATENT DOCUMENTS

| | | | |
|---|---|---|---|
| 2124669 | 2/1984 | United Kingdom | 162/352 |

OTHER PUBLICATIONS

"New Sucton Box Design and Cover Material" Paper Trade Journal, Jan. 18, 1965.

*Primary Examiner*—Karen M. Hastings
*Attorney, Agent, or Firm*—Robert R. Jackson

[57] ABSTRACT

A suction box for use in drying a felt web in a papermaking machine has one or more cover members in contact with a surface of the felt web. The surface of at least one of these cover elements which normally contacts the felt web has a leading portion which is feathered or inclined away from the surface of the felt web in the direction opposite the direction of motion of the felt web. This allows the felt web to come into contact with the cover member surface more gradually, which reduces wear on the felt.

19 Claims, 5 Drawing Sheets

FIG. 2
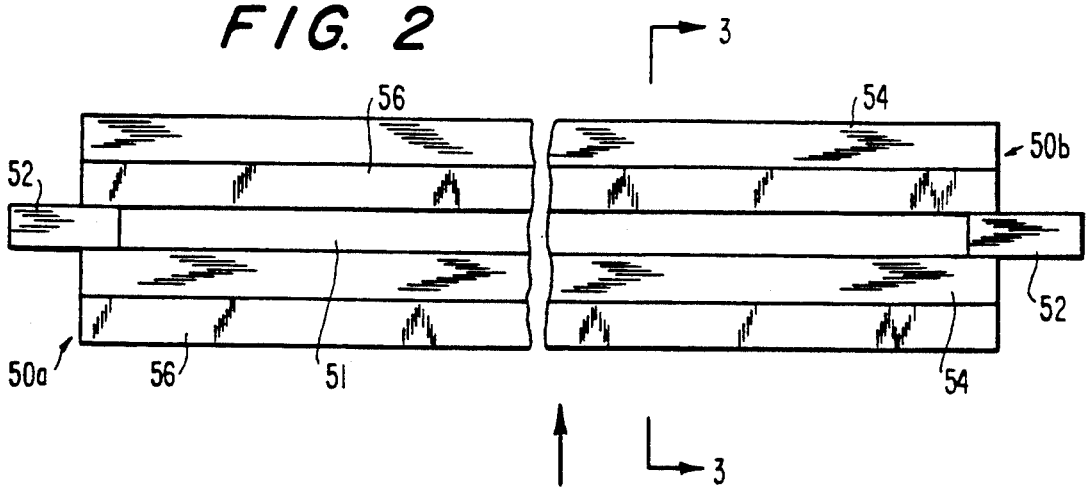
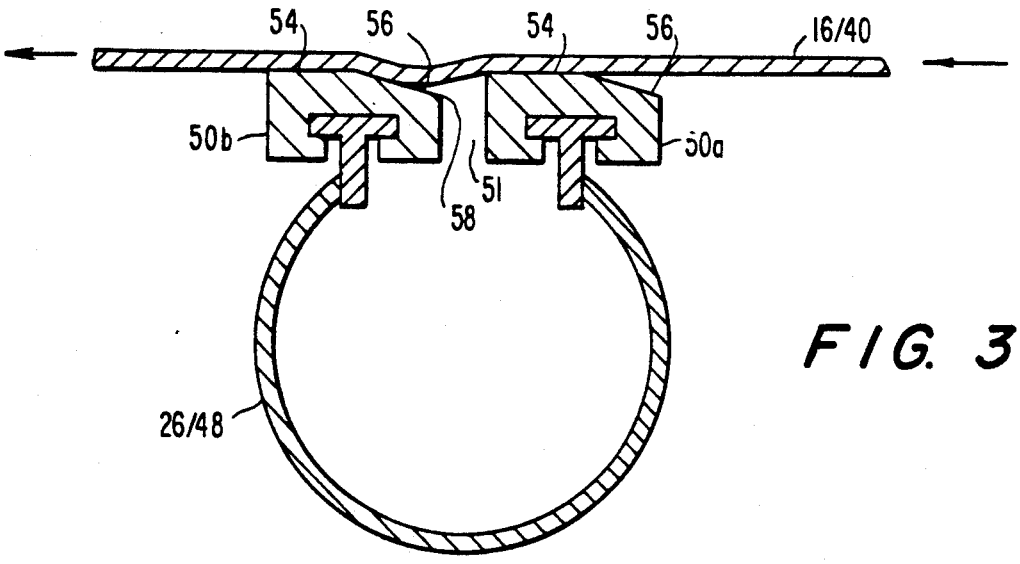
FIG. 3
FIG. 4
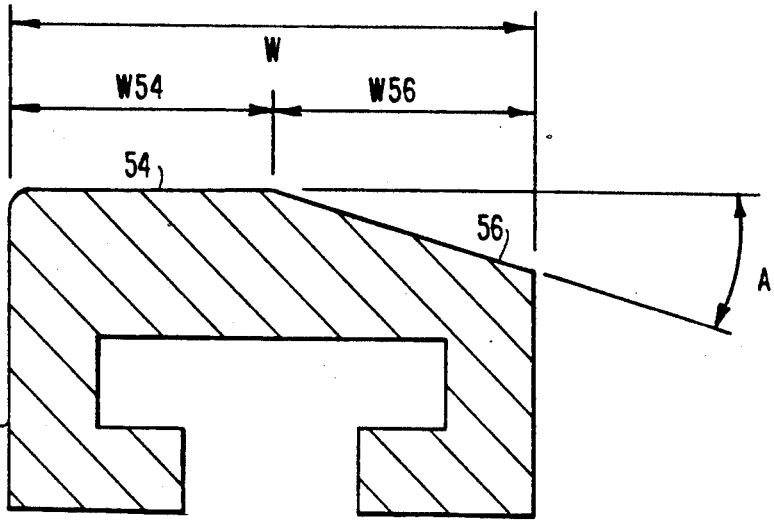

SUCTION BOX COVERS FOR CLEANING PAPERMAKING MACHINE FELTS

BACKGROUND OF THE INVENTION

This invention relates to papermaking machines, and more particularly to the covers used on suction boxes in contact with the felts in papermaking machines.

The felts used, for example, in the press section of papermaking machines are critical to proper dewatering of the paper web. These felts are an expensive component of the machine and downtime for replacement results in costly lost production; therefore, it is very important to extend their usable lives as much as possible. In a typical installation, a felt is formed as an endless loop (with or without a transverse seam). A portion of the length of this loop is in contact with one surface of the paper web between the upstream Fourdrinier wire section of the papermaking machine and the downstream dryer section of the machine. The paper and felt are passed through the nip between a pair of press rolls in order to transfer moisture from the paper web to the felt. The paper is then separated from the felt and continues on, while the felt returns in its endless loop. To prepare the felt to again contact the paper web the felt is typically subjected to a high pressure liquid cleaning shower, followed by passage over one or more suction boxes in order to remove liquid and contaminants from the felt and thereby dry it. The typical suction box has a stationary cover over which the felt is pulled at high speed. Slots or other apertures in the cover communicate the reduced pressure inside the suction box to one side of the felt, thereby pulling the felt firmly against the suction box cover. This firm contact between the felt and the suction box cover can cause the cover to wear the felt, thereby shortening the felt's life.

In view of the foregoing, it is an object of this invention to provide improved suction box covers.

It is a more particular object of this invention to provide suction box covers which reduce the wear on papermaking machine felts in contact with those covers.

SUMMARY OF THE INVENTION

These and other objects of the invention are accomplished in accordance with the principles of the invention by providing suction box covers which have leading edges which are feathered or inclined away from the felt as the felt approaches the suction box and/or as the felt leaves the suction zone. This feathering allows the felt to gradually come into contact with the suction box cover so that the felt does not impact or abruptly contact an edge or corner of the cover. Such abrupt contact with an edge of a suction box cover can be an important source of felt wear, especially at a seam in the felt if there is one. If the suction box cover has one or more long continuous slots, it may be especially helpful to feather the edge of the cover which is on the downstream side of each slot to help counteract the effect of the suction pulling the felt into the slot and thereby into especially firm contact with that edge. As an alternative to feathering the downstream edge of the slot, the cover may be provided with narrow bridges across the slot to help reduce the tendency of the suction to pull the felt into the slot.

Further features of the invention, its nature and various advantages will be more apparent from the accompanying drawings and the following detailed description of the preferred embodiments.

BRIEF DESCRIPTION OF THE DRAWINGS

FIG. 2 is a simplified fragmentary plan view of an illustrative suction box constructed in accordance with this invention.

FIG. 3 is a sectional view taken along the line 3—3 in FIG. 2 with a fragment of a typical felt added.

FIG. 4 is an enlargement of a portion of FIG. 3.

DETAILED DESCRIPTION OF THE PREFERRED EMBODIMENTS

Figure 1:
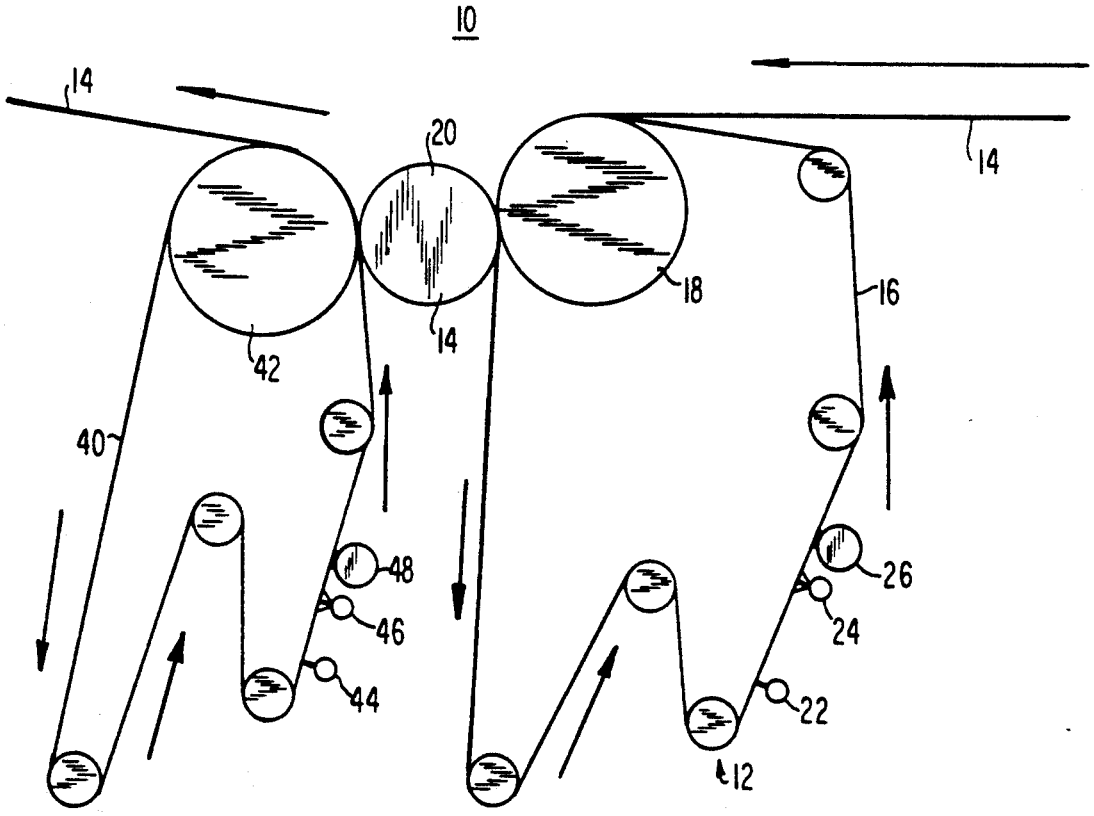
FIG. 1 is a simplified elevational view of a portion of a papermaking machine which can employ the present invention.

FIG. 1 shows the press section 12 of a typical papermaking machine 10. The paper web 14 enters press section 12 from the Fourdrinier wire or forming section (not shown) of the machine. A first endless felt 16 picks up the paper web and carries it through the nip between press rolls 18 and 20 where some of the moisture in the paper transfers to the felt. After passing through this nip, felt 16 is separated from the paper and returns in its endless loop so that it can again contact the paper upstream from roll 18. As part of this recirculation of felt 16, the felt is reconditioned by subjecting it to a high pressure liquid cleaning shower from shower source 22, by subjecting it to a lubricant shower from lubricant source 24, and by then passing it over suction box 26. Reduced pressure in suction box 26 is communicated to one side of the felt web via one or more slots or other apertures in a cover of the suction box which is in contact with the felt. The suction in the suction box pulls air through the felt and moisture from the felt in order to dry it.

The paper separated from felt 16 travels around the underside of roll 20 and then contacts second felt web 40 which carries it through the nip between press rolls 20 and 42. Additional moisture is transferred from the paper to felt 40 as the paper and felt pass through this second press nip. After passing through this nip, the paper is separated from felt 40 and enters the dryer section (not shown) of the machine. Felt 40 returns in its endless loop and is reconditioned for reuse in the same way that felt 16 is recirculated and reconditioned, i.e., felt 40 is subjected to a high pressure cleaning liquid shower from source 44, to a lubricant shower from lubricant source 46, and to suction as it passes over suction box 48.

It will be understood that FIG. 1 shows only one example of papermaking machines in which the present invention can be practiced, and that the invention is equally applicable to many other machine configurations. For example, while only one suction box is shown for each felt in FIG. 2, it is quite common to have two such boxes, one after the other, for each felt.

Typical operating parameters for machines of the type described above are as follows: speed of machine: about 200 to about 6000 feet per minute; width of felt: up to about 400 inches; length of felt: 60 to 80 feet; thickness of felt about 0.1 to about 0.25 inches; material of felt: typically synthetic; suction box vacuum about 10 to about 20 inches of mercury.

In accordance with the present invention, the covers of suction boxes such as 26 and 48 are configured to substantially reduce wear on the felt passing over the suction box. Suction boxes are conventionally constructed in several different ways, and it is desirable to provide suction box covers in accordance with this invention which can be used on existing suction boxes without having to change or reconstruct the suction boxes. For example, FIGS. 2 and 3 show an embodiment in which the cover of typical suction box 26 or 48 is formed by two separate or substantially separate longitudinal members 50*a* and 50*b*, sometimes called wear strips. Each of members 50 is removably mounted on a respective one of the edges of suction box 26/48 by being fitted on a T-shaped "T-bar" on the edge of the box. Other forms of mounting (e.g., dovetail mountings) are known, and members 50 can be made with whatever shape is required to adapt them to the existing suction boxes of the machine. Members 50 can be connected to one another at their respective opposite ends, or, as shown in FIG. 2, deckle plates 52 can be inserted between the respective opposite ends of members 50 to prevent vacuum leaks at the ends of the suction box. With this construction, a single long slot 51 is formed between members 50 for communicating the suction in box 26/48 to the felt 16/40 passing over that box.

The upper surface of each of members 50 has a substantially flat trailing portion 54 which is downstream in the direction of motion of the associated felt 16 or 40. Each trailing portion 54 is substantially parallel to the nominal plane of the felt 16/40 passing over the suction box. In addition, the upper surface of each of members 50 has a substantially flat leading portion 56 which is upstream, opposite the direction of motion of the associated felt 16/40, and which is feathered or inclined away from the felt in the upstream direction. This feathering of the leading portion 56 of the upper surface of each of members 50 allows felt 16/40 to gradually (rather than abruptly) come into contact with the upper surface of each member 50. This significantly reduces wear on the felt, especially at any transverse seam in the felt.

There are several factors which influence the degree of the above-described feathering. In the first place, it is desirable for at least about 50% of the width of the top surface of each member 50 to remain parallel to the nominal plane of the felt so that trailing portions 54 do not become too narrow. In other words, dimension W54 in FIG. 4 is preferably at least about 50% of dimension W. This helps prevent excessive wear of trailing surface portion 54, and also helps to distribute the contact force to a suitably large portion of the surface area of the felt. On the other hand, the leading feathered portion 56 should be wide enough so that it can perform its function of allowing the felt to gradually come into contact with member 50 without being so steeply inclined that the initial contact of the felt with the member is not in fact gradual. In embodiments of the type shown in FIGS. 1–4, dimension W56 is typically in the range from about 25% to about 50% of dimension W. By way of illustration, members 50 may typically be about 2 inches wide (dimension W), and slot 51 may be about 0.5 to 1.0 inches wide. Thus dimension W56 is typically about 0.5 to 1.0 inch. The angle A of inclination of leading portion 56 may be influenced by dimension W56. If W56 is relatively large, angle A can be relatively small (e.g., about 5°). If W56 is relatively small, angle A may have to be somewhat larger (e.g., up to about 20°). An angle A of about 10° is a preferred compromise in many situations.

Another objective which it may be desirable to meet is to have the extreme leading edge 58 of the member 50*b* which follows slot 51 just lightly touch the adjacent surface of the felt as the felt leaves slot 51. This condition is shown more precisely in FIG. 5. The vacuum in suction box 26/48 tends to pull the felt down into slot 51 as shown in both FIGS. 3 and 5. In addition, of course, the vacuum is pulling moisture from the felt in order to dry it as desired. As the felt is about to leave the slot, some of this moisture may remain as droplets on the side of the felt adjacent the suction box cover. The leading edge 58 of downstream member 50*b* can act as a doctor blade for removing these droplets if this edge at least lightly contacts the felt surface. Accordingly, it may be desirable to choose dimensions W56 and A so that edge 58 does just lightly contact the surface of the felt given such other parameters as suction pressure, felt speed and stiffness, etc.

Figure 5:
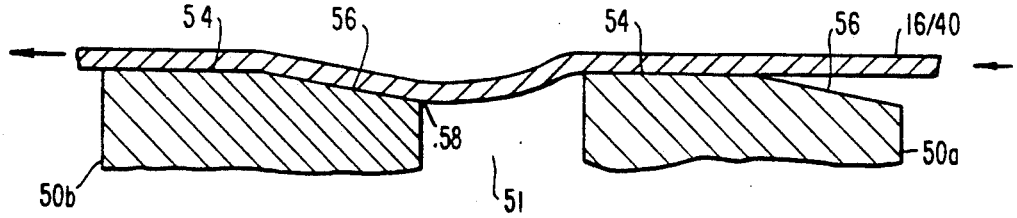
FIG. 5 is an enlargement of another portion of FIG. 3 showing a possible modification in accordance with this invention.
Figure 6:
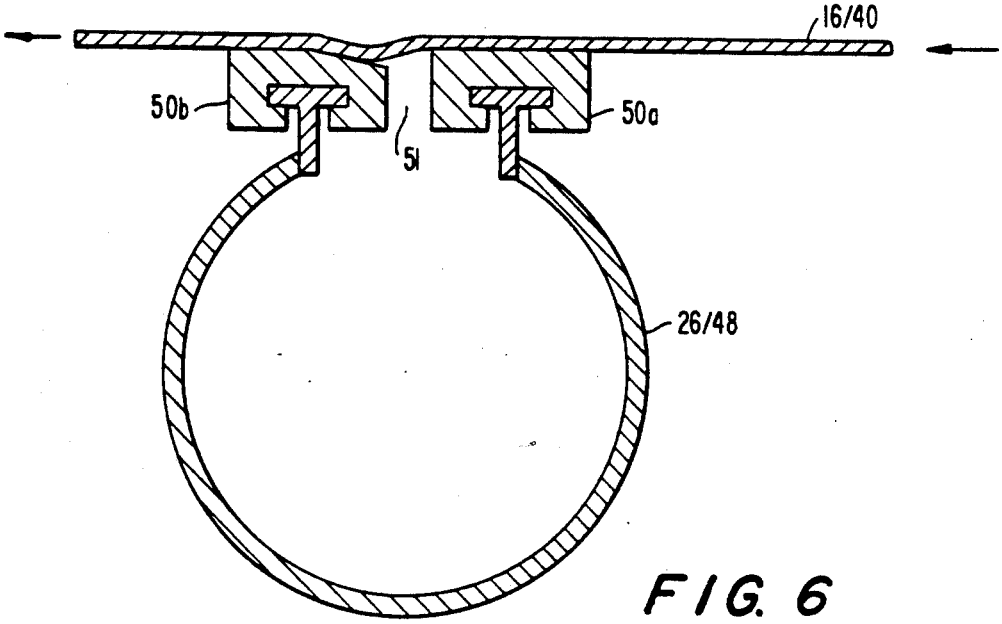
FIG. 6 is a view similar to FIG. 3 showing an alternative embodiment of the invention.

Although FIGS. 3 and 5 show both of members 50*a* and 50*b* to be the same or substantially the same, these two member could be different. For example, each of members 50 could be adapted to the different conditions applicable to each. It may also not be desired in some situations to form both of members 50*a* and 50*b* in accordance with this invention. For example, although believed to be less desirable, member 50*a* could be of conventional shape as shown in FIG. 6, while only member 50*b* is shaped in accordance with this invention. Alternatively, leading member 50*a* could be shaped in accordance with this invention, while trailing member 50*b* has a conventional shape (like member 50*a* in FIG. 6).

Figure 7:
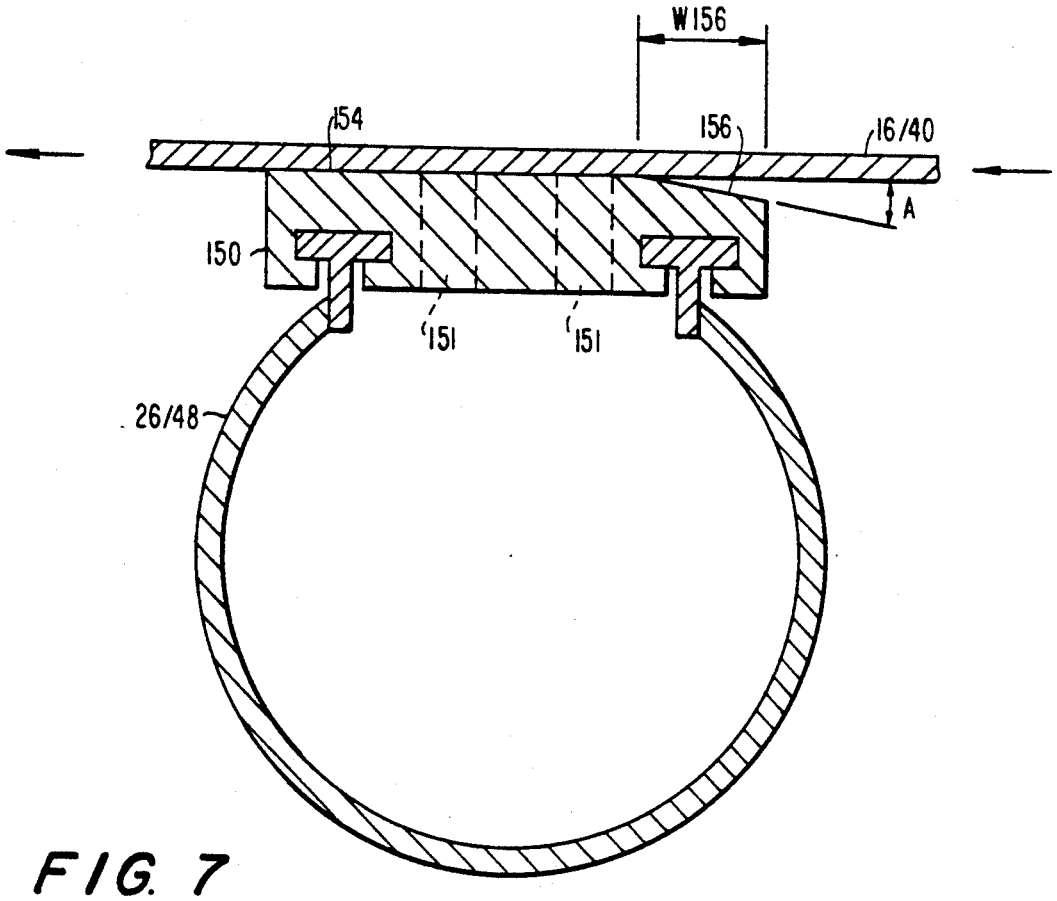
FIG. 7 is a view generally similar to FIG. 3 showing another alternative embodiment of the invention.

As suggested above, not all suction boxes are adapted to receive separate or substantially separate leading and trailing longitudinal members like members 50 in FIGS. 2–6. Many suction boxes are designed to receive a single cover member which includes apertures for communicating the reduced gas pressure in the suction box to the felt passing over the box. FIG. 7 shows an example of such a suction box 26/48 having a single cover member 150. Cover member 150 is removably mounted on the open side of suction box 26/48 by means of T-bars on each side of the opening in the otherwise substantially cylindrical suction box. The surface of cover member 150 which is adjacent to and partly in contact with a surface of felt 16/40 includes a substantially flat trailing portion 154 which is substantially parallel to the nominal plane of the felt, and a substantially flat leading portion 156 which is feathered or inclined away from the felt in the upstream direction. In addition, cover member 150 has apertured regions 151 downstream from leading portion 156 which communicate the reduced pressure in the suction box to the surface of the felt which is in contact with trailing portion 154. As in the embodiments discussed above, dimension W156 and angle A are chosen so that felt 16/40 gradually contacts the surface of member 150 as it approaches that member. Dimension W156 and angle A may be respectively similar to dimension W56 and angle A in the previously described embodiments.

Figure 8:
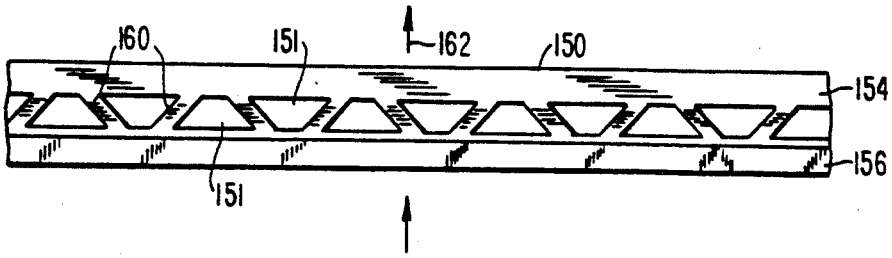
FIG. 8 shows a possible embodiment of a surface of the structure shown in FIG. 7 in accordance with this invention.
Figure 9:
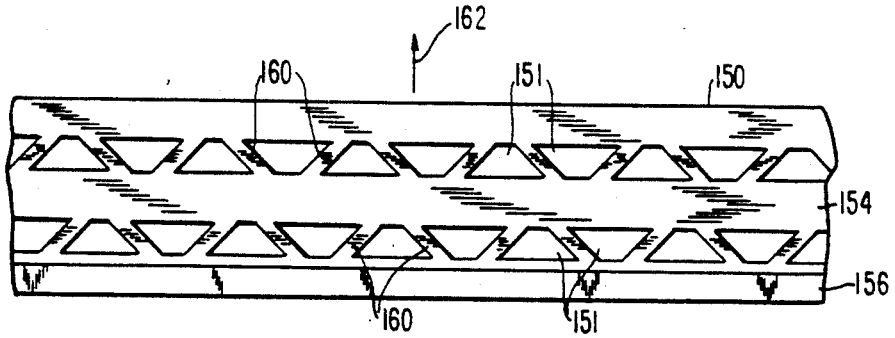
FIG. 9 shows another possible embodiment of the surface shown in FIG. 8.
Figure 10:
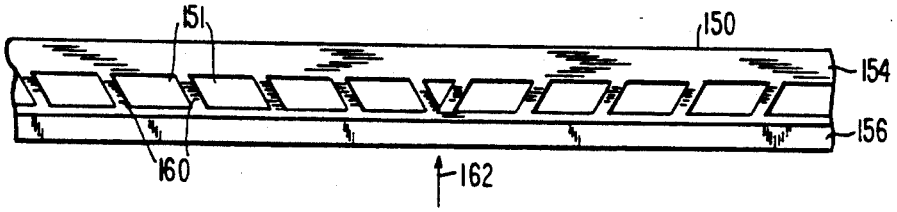
FIG. 10 shows still another possible embodiment of the surface shown in FIG. 8.

To help prevent felt 16/40 from being drawn down into apertured regions 151, these regions are preferably bridged by many relatively narrow, closely spaced bridges 160 as shown, for example, in any of FIGS. 8–10. In FIG. 8 a single row of apertures 151 are interspersed with bridges 160 having angles of inclination relative to the direction 162 of felt travel which alternate (first to the right, then to the left, and so on) across the machine. Bridges 160 are inclined to reduce their tendency to leave wet streaks in the felt which could streak the paper being made. The angle of inclination is preferably great enough and the width of each bridge is preferably narrow enough so that no part of the felt does not pass over at least a portion of an aperture 151 parallel to axis 162. Alternating inclination is used so that there is no net left or right force on the felt. In FIG. 9 two rows of apertures 151 interspersed with bridges 160 are shown. Each row is similar to the row shown in FIG. 8, but the rows are offset from one another left to right as viewed in FIG. 9 so that the bridges in one row are not aligned with the bridges in the other row parallel to felt motion axis 162. In FIG. 10 a modified herringbone pattern of apertures 151 and interspersed bridges 160 is shown. In other words, on one side of the central longitudinal axis of the felt, bridges 160 are inclined in one direction relative to axis 162, and on the other side of the felt, bridges 160 are inclined in the other direction relative to axis 162. Again, bridges 160 are narrow enough and the angle of inclination great enough so that no part of the width of the felt does not pass over at least a portion of an aperture parallel to axis 162. Typical dimensions for elements 151 and 160 are as follows: length of apertures 151 (parallel to axis 162): about 1.25 to about 1.5 inches; width of apertures 151 (perpendicular to axis 162): about 2 to about 4 inches; width of bridges 160 (substantially perpendicular to axis 162): about 0.5 to about 0.75 inches. Thus bridges 160 support the felt across the apertured region and substantially prevent it from deflecting down into the apertures as a result of the suction in the suction box.

Figure 11:
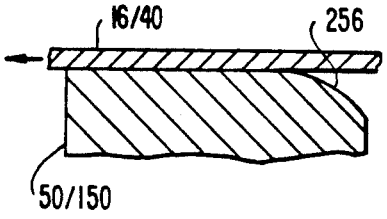
FIG. 11 is another view similar to a portion of FIG. 3 showing still another possible embodiment of the invention.
Figure 12:
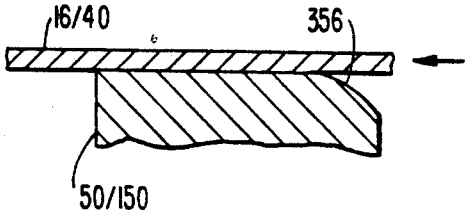
FIG. 12 is another view similar to a portion of FIG. 3 showing yet another possible embodiment of the invention.

Although the feathering of the leading portion of the suction box surfaces over which the felts pass in the embodiments shown and described above is planar, the feathering could have another shape such as an arc 256 of an ellipse as shown in FIG. 11 or an arc 356 of a circle as shown in FIG. 12. In all cases, the object is to bring the felt into contact with the suction box cover gradually rather than abruptly. Unless the doctoring action described above in connection with FIG. 5 is desired, the feathering of the leading portion of the suction box cover surface in contact with the felt should be great enough so that at first no portion of the felt (including any portion of what may be a relatively deep nap) initially contacts the feathered surface portion, and so that the felt only gradually begins to contact that surface as the felt continues to move along that surface. If doctoring action as in FIG. 5 is desired, then the feathering may be slightly shallower so that the leading edge 58 of the feathered surface contacts the felt nap just enough to doctor moisture off the felt.

Conventional suction box cover materials such as polyethylene or ceramics may be used to make the suction box covers of this invention.

It will be understood that the foregoing is only illustrative of the principles of the invention and that various modifications can be made by those skilled in the art without departing from the scope and spirit of the invention. For example, although FIGS. 2, 3, and 6 show suction boxes with only one slot 51, such boxes may have more than one slot, and one or more additional similar members 50 may be provided to define one or more additional slots.

The invention claimed is:

1. In a papermaking machine having a forming section for forming and partly drying a paper web, and a separate press section to which the formed and partly dried paper web is transferred for further drying, press section apparatus comprising:

a moving felt web for receiving the paper web from the forming section; and a suction box for applying suction to said moving felt web, said felt web being substantially planar adjacent to said suction box and moving relative to said suction box from a location upstream from said suction box to a location downstream from said suction box, said suction box including:

a longitudinal chamber extending longitudinally substantially parallel to the plane of said felt web and transverse to the direction of motion of said felt web, said chamber having an open side adjacent said felt web for communicating reduced pressure in said chamber to said felt web, said open side having substantially parallel first and second edges which are respectively upstream and downstream of said open side in relation to the direction of motion of said felt web;

a first wear strip mounted on said first edge; and a second wear strip mounted on said second edge, said first and second wear strips being spaced from one another parallel to the direction of motion of said felt web, each of said wear strips having a surface which includes a substantially planar portion substantially parallel to the plane of said felt web, said planar portions of said first and second wear strips being in contact with respective first and second portions of a surface of said felt web, and said surface of at least one of said wear strips including a feathered portion which is upstream from the remainder of said surface in relation to the direction of motion of said felt web, said feathered portion being inclined away from the plane of said felt web in the direction opposite the direction of motion of said felt web so that said felt web comes into contact with said surface of said at least one of said wear strips more gradually than it would in the absence of said feathered portion, said feathered portion being substantially planar and at least about 25% of the dimension of said surface of said at least one of said wear strips parallel to the direction of motion of said felt web, and wherein said paper web is in contact only with a third portion of a surface of said felt web, said third portion being upstream from said first portion in relation to the direction of motion of said felt web.

2. The apparatus defined in claim 1 wherein said feathered portion is inclined away from said plane by an angle in the range from about 5° to about 20°.

3. The apparatus defined in claim 2 wherein said feathered portion is inclined away from said plane by an angle of approximately 10°.

4. The apparatus defined in claim 1 wherein said feathered portion has an upstream edge which is upstream from the remainder of said feathered portion in relation to the direction of felt motion, and wherein no portion of said felt contacts said upstream edge.

5. The apparatus defined in claim 1 wherein said feathered portion has an upstream edge which is upstream from the remainder of said feathered portion in relation to the direction of felt motion, and wherein said upstream edge contacts said surface of said felt enough to doctor at least some moisture from said surface of said felt.

6. The apparatus defined in claim 1 wherein the dimension of said feathered portion parallel to said direction of felt motion is in the range from about 0.5 to about 1.0 inch.

7. The apparatus defined in claim 1 wherein said at least one of said wear strips is said second wear strip.

8. The apparatus defined in claim 1 wherein said first, second, and third portions are all portions of the same surface of said felt web.

9. The apparatus defined in claim 1 further comprising:

means for spraying liquid on said felt web intermediate said third portion and said first portion, and wherein said suction box subsequently withdraws at least some of said liquid from said felt web.

10. In a papermaking machine having a forming section for forming and partly drying a paper web and a separate press section to which the formed and partly dried web is transferred for further drying, press section apparatus comprising:

a moving felt web for receiving the paper web from the forming section; and a suction box for applying suction to said moving felt web, said felt web being substantially planar adjacent to said suction box and moving relative to said suction box from a location upstream from said suction box to a location downstream from said suction box, said suction box including:

a longitudinal chamber extending substantially parallel to the plane of said felt web and transverse to the direction of motion of said felt web, said chamber having an open side adjacent said felt web, said open side having substantially parallel first and second edges which are respectively upstream and downstream of said open side in relation to the direction of motion of said felt web; and a cover member mounted on said chamber between said first and second edges, said cover member having a surface which includes a substantially planar portion substantially parallel to the plane of said felt web, said planar portion of said cover member being in contact with a first portion of a surface of said felt web, said surface of said cover member having a feathered portion which is upstream from the remainder of said surface in relation to the direction of motion of said felt web, said feathered portion being inclined away from the plane of said felt web in the direction opposite the direction of motion of said felt web so that said felt web comes into contact with said surface of said cover member more gradually than it would in the absence of said feathered portion, said feathered portion being substantially planar and at least about 25% of the dimension of said surface of said cover member parallel to the direction of motion of said felt web, and said remainder of said surface of said cover member being perforated to communicate reduced pressure in said chamber to said felt web, and wherein said paper web is in contact only with a second portion of said felt web, said second portion being upstream from said first portion in relation to the direction of motion of said felt web.

11. The apparatus defined in claim 10 wherein said feathered portion is inclined away from said plane by an angle in the range from about 5° to about 20°.

12. The apparatus defined in claim 11 wherein said feathered portion is inclined away from said plane by an angle of approximately 10°.

13. The apparatus defined in claim 10 wherein said feathered portion has an upstream edge which is upstream from the remainder of said feathered portion in relation to the direction of felt motion, and wherein no portion of said felt contacts said upstream edge.

14. The apparatus defined in claim 10 wherein said remainder of said surface of said cover member is perforated with a plurality of apertures and includes bridge portions between adjacent apertures for reducing the tendency of the felt to be deflected down into said apertures by the reduced pressure in said suction box.

15. The apparatus defined in claim 14 wherein each bridge portion has a substantially longitudinal shape which is inclined relative to the direction of felt motion so that no portion of the felt which contacts a bridge portion does not also pass over a portion of at least one of the apertures adjacent to said bridge portion.

16. The apparatus defined in claim 14 wherein said apertures form a plurality of rows transverse to said direction of felt motion, wherein said bridge portions are located between adjacent apertures in each of said rows, and wherein said bridge portions in one row are offset from the bridge portions in another row transverse to the direction of felt motion.

17. The apparatus defined in claim 10 wherein the dimension of said feathered portion parallel to said direction of felt motion is in the range from about 0.5 to about 1.0 inch.

18. The apparatus defined in claim 10 wherein said first and second portions are all portions of the same surface of said felt web.

19. The apparatus defined in claim 10 further comprising:

means for spraying liquid on said felt web intermediate said second portion and said first portion, and wherein said suction box subsequently withdraws at least some of said liquid from said felt web.

* * * * *